United States Patent [19]

Buttke et al.

[11] Patent Number: 4,990,241

[45] Date of Patent: Feb. 5, 1991

[54] HYDROTREATING PROCESS TO MINIMIZE CATALYST SLUMPING

[75] Inventors: Robert D. Buttke, Naperville, Ill.; Robert E. Boening, Galveston, Tex.; Frank W. Pickell, Alvin, Tex.

[73] Assignee: Amoco Corporation, Chicago, Ill.

[21] Appl. No.: 238,928

[22] Filed: Aug. 31, 1988

[51] Int. Cl.[5] ..... C10G 45/00

[52] U.S. Cl. ..... 208/143; 208/146; 208/158

[58] Field of Search ..... 208/143, 152, 146, 166, 208/157, 158; 422/211, 212, 216, 218, 222

[56] References Cited

U.S. PATENT DOCUMENTS

| | | | |
|---|---|---|---|
| 3,188,286 | 6/1965 | Van Driesen | 208/143 |
| 4,392,943 | 7/1983 | Euzen et al. | 208/166 X |
| 4,444,653 | 4/1984 | Euzen et al. | 208/166 X |
| 4,571,326 | 2/1986 | Bischoff et al. | 422/220 X |
| 4,615,789 | 10/1986 | Bridge et al. | 208/143 |
| 4,659,455 | 4/1987 | Dall et al. | 208/152 |
| 4,664,782 | 5/1987 | Galiasso et al. | 208/143 |
| 4,750,989 | 6/1988 | Soderberg | 208/148 X |
| 4,753,721 | 6/1988 | McDaniel et al. | 208/143 |

*Primary Examiner*—Glenn Caldarola
*Assistant Examiner*—Nhat Phan
*Attorney, Agent, or Firm*—Thomas W. Tolpin; William H. Magidson; Ralph C. Medhurst

[57] ABSTRACT

A hydrotreating process is provided with at least one deflector to minimize catalyst agglomeration and buildup. Preferably, the deflectors comprise an inner annular baffle and an outer annular baffle.

8 Claims, 6 Drawing Sheets

FRESH CATALYST
56
66
64
LIQUID LEVEL
80
EXPANDED CATALYST BED LEVEL
84
16
SETTLED CATALYST BED
52
82
54
92
63
2
2
104
108
88
100
102
106
74
72
62
152
76
60
90
86
70
68
SPENT CATALYST OUTLET
88
PRODUCT OIL & H2 RICH GAS
58
RESID AND H2 RICH GAS FEED
78

HYDROTREATING PROCESS TO MINIMIZE CATALYST SLUMPING

BACKGROUND OF THE INVENTION

This invention relates to resid hydrotreating and, more particularly, to a process to minimize catalyst slumping.

In the past, fluctuations of supply, demand, costs, and prices of oil have created instability and uncertainty for net oil consuming countries, such as the United States, to attain adequate supplies of high-quality, low-sulfur, petroleum crude oil (sweet crude) from Saudi Arabia and other countries at reasonable prices for conversion into gasoline, fuel oil, and petrochemical feed-stocks. In an effort to stabilize the supply and availability of crude oil at reasonable prices, Amoco Oil Company has developed constructed and commercialized extensive, multimillion dollar refinery projects under the Second Crude Replacement Program (CRP II) to process poorer quality, high-sulfur, petroleum crude oil (sour crude) and demetallate, desulfurize, and hydrocrack resid to produce high-value products, such as gasoline, distillates, catalytic cracker feed, metallurgical coke, and petrochemical feedstocks. The Crude Replacement Program is of great benefit to the oil-consuming nations by providing for the availability of adequate supplies of gasoline and other petroleum products at reasonable prices while protecting the downstream operations of refining companies.

During resid hydrotreating, a bed of hydrotreating catalyst is expanded by circulating oil through the bed, and resid oil (resid) mixed with hydrogen-rich gases and passed through the catalyst bed in a three-phase mixture of oil, catalyst, and gas bubbles to produce more valuable lower-boiling liquid products. Over time, in many units, however, significant amounts of catalyst often slump, cluster, agglomerate, build up, adhere, and stick to the walls of the reactor, downcomer and grid. Slumping catalyst piles up and does not circulate and expand nor does it effectively mix or promote the reaction of the oil and gases. Furthermore, slumping catalyst can block the flow of oil and gases, reduce available reactor volume, and become stagnant, inactive, and ineffective.

Catalyst agglomeration decreases the efficiency of hydrotreating and diminishes the conversion of resid to more valuable lower-boiling liquid products. Catalyst buildup and clustering can cause the catalyst bed to become unstable. It can also cause excess gas channeling, stagnant zones, and loss of product quality. Furthermore, catalyst accumulation and piling against the walls can cause the oil (resid) to channel (rise) faster up one side of the reactor than the other and increase the maldistribution of the oil and gases. In extreme cases, catalyst slumping can cause hot spots which can rupture the vessel wall.

Catalyst buildup and slumping can also accelerate coke formation and plug up the grid as well as the outlet and inlet lines. It can lead to premature shutdown, extended downtime, and increased frequency of maintenance and repair. Increased maintenance and repair requires additional manpower and is time consuming, tedious, and expensive. It further decreases the reactor's efficiency and adversely affects the operability, performance, and profitability of the unit.

Over the years, various processes and equipment have been suggested or developed to increase the efficiency of hydrotreating resid and/or processing other hydrocarbons. Typifying such prior art processes and equipment are those found in U.S. Pat. Nos. 2,425,098; 2,910,425; 2,934,411; 3,104,155; 3,227,527; 3,288,567; 3,527,575; 3,607,127; 3,904,549; 4,035,152; 4,135,889; 4,414,100; 4,320,089; 4,510,021; 4,661,265; 4,662,669; 4,715,996; 4,750,989; and 4,753,721.

It is, therefore, desirable to provide an improved resid hydrotreating unit (RHU) and process which overcomes most, if not all, of the above problems.

SUMMARY OF THE INVENTION

An improved hydrotreating unit (apparatus) and process is provided which is efficient, effective and economical. Advantageously, the novel hydrotreating unit and process minimizes slumping, clustering, agglomeration and buildup of catalyst on the walls, grid, and downcomer of the reactor, reduces downtime, and lowers maintenance and operating expenses. Desirably, the hydrotreating unit and process increase the conversion and yield of feedstock, preferably comprising resid, to more valuable products.

To this end, the hydrotreating unit and process has at least one deflector, baffle, or internal, and preferably outer and inner deflectors with downwardly sloping walls, to deflect the catalyst downwardly at an angle of inclination away from the downcomer and walls of the vessel comprising the reactor. The deflectors cooperate with each other to reduce the cross-sectional area of the grid and increase the upward velocity and circulation rate of oil, gas, and catalyst being fed into the reactor by various feed lines. Desirably, the increased velocity helps keep the catalyst moving above the grid.

Preferably, the deflectors are positioned in proximity to the grid. In the desired form, the outer deflector comprises an outer annular baffle with a triangular cross section positioned adjacent to the walls of the reactor, and the inner deflector comprises an inner annular baffle with a frustoconical cross-section positioned adjacent the downcomer. If desired, the cross section of the deflectors can be rounded, concave, convex, conical, polygonal, or some other shape. The deflectors can also be made of interlocking complementary segments (pieces) for ease of manufacture, assembly, and shipment as well as to accommodate retrofitting of existing units.

During hydrotreating, an oil feedstock, such as resid, and hydrogen-rich gases are fed, injected, and passed into the reactor, preferably through a common (combined) feed line. Hydrotreating catalyst is dispensed and dispersed into the reactor through a catalyst inlet line to form a catalyst bed above the grid. The catalyst bed is expanded, by an ebullated pump while the oil feed-stock and gases are mixed, contacted, and hydroprocessed (hydrotreated), to produce upgraded hydrotreated oil.

A more detailed explanation of the invention is provided in the following description and appended claims taken in conjunction with the accompanying drawings.

DETAILED DESCRIPTION OF THE PREFERRED EMBODIMENT

Figure 7:
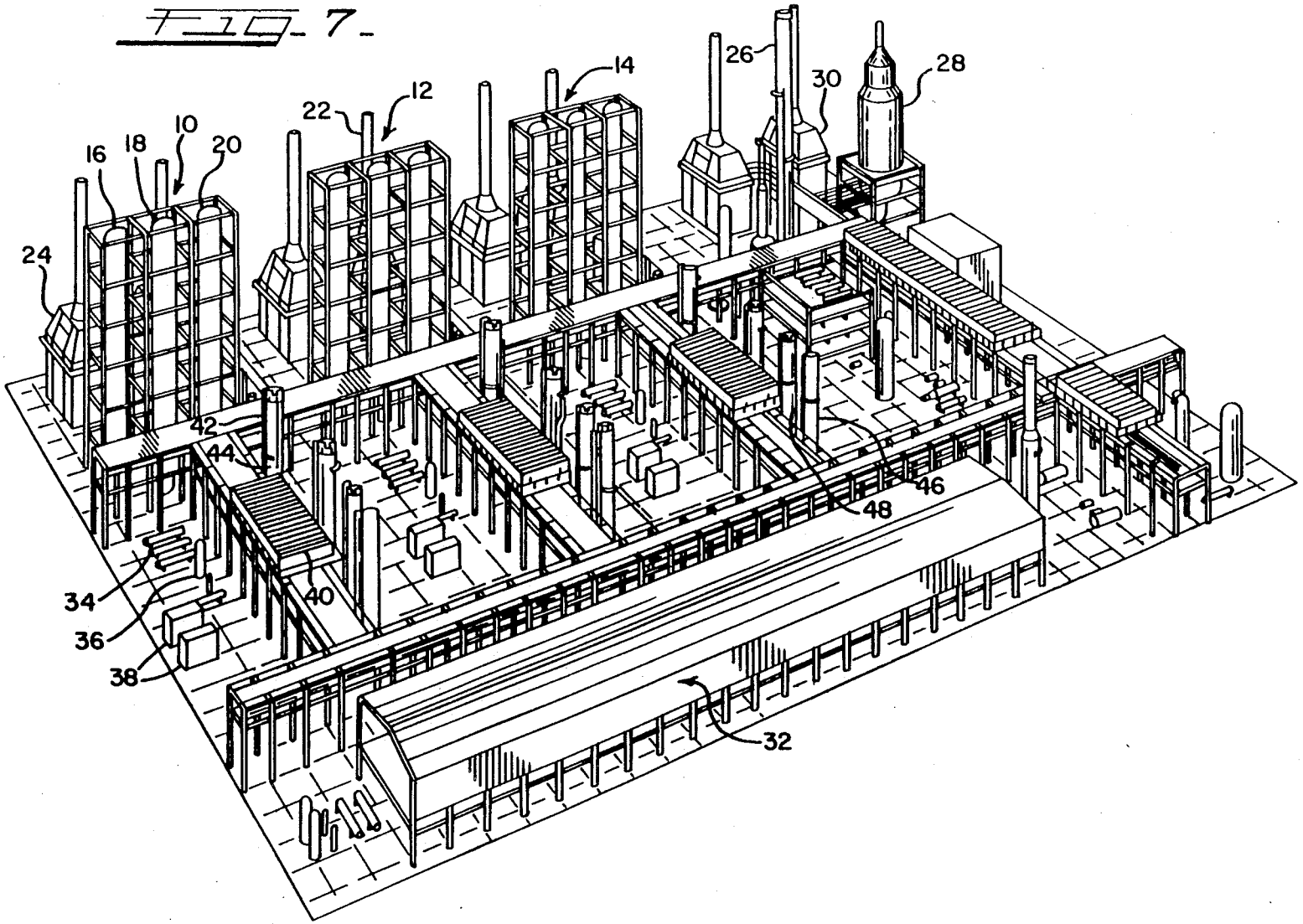
FIG. 7 is a perspective view of resid hydrotreating units and associated refinery equipment.

Referring to FIG. 7, high-sulfur resid oil feed, also referred to as vacuum-reduced crude, comprising 1,000+° F. resid and heavy gas oil, is fed into resid hydrotreating units 10, 12, and 14 along with hydrogen-rich feed gases. Each resid hydrotreating unit is a reactor train comprising a cascaded series or set of three ebullated (expanded) bed reactors 16, 18, and 20. In the reactors, the resid is hydroprocessed (hydrotreated) in the presence of fresh and/or equilibrium hydrotreating catalyst and hydrogen to produce an upgraded effluent product stream leaving used spent catalyst. Hydroprocessing in the RHU includes demetallation, desulfurization, denitrogenation, resid conversion, oxygen removal (deoxygenation), and removal of Rams carbon.

As shown in FIG. 7, the resid hydrotreating units and associated refining equipment comprise three identical parallel trains of cascaded ebullated bed reactors 16, 18, and 20, as well as hydrogen heaters 22, influent oil heaters 24, an atmospheric tower 26, a vacuum tower 28, a vacuum tower oil heater 30, a hydrogen compression area 32, oil preheater exchangers 34, separators 36, recycled gas compressors 38, air coolers 40, raw oil surge drums 42, sponge oil flash drums 44, amine absorbers and recycled gas suction drums 46, and sponge oil absorbers and separators 48. Each of the reactors 16, 18, and 20 are structurally generally similar to each other.

Each of the reactor trains comprises three ebullated bed reactors in series. The oil feed comprises resid oil (resid) and heavy gas oil. The gas feed comprises hydrogen-rich gases comprising upgraded recycled gases and fresh makeup gases. Demetallation primarily occurs in the first ebullated bed reactor in each train. Desulfurization occurs throughout the ebullated bed reactors in each train. The effluent product stream typically comprises light hydrocarbon gases, hydrotreated naphtha, distillates, light and heavy gas oil, and unconverted hydrotreated resid. The hydrotreating catalyst typically comprises a hydrogenating component on a porous refractory, inorganic oxide support.

The resid hydrotreating unit is quite flexible and, if desired, the same catalyst can be fed to one or more of the reactors or a separate demetallation catalyst can be fed to the first reactor while a different catalyst can be fed to the second and/or third reactors. Alternatively, different catalysts can be fed to each of the reactors. The spent catalyst typically contains nickel, sulfur, vanadium, and carbon (coke). Many tons of catalyst are transported into, out of, and replaced in the ebullated bed reactors daily.

Figure 1:
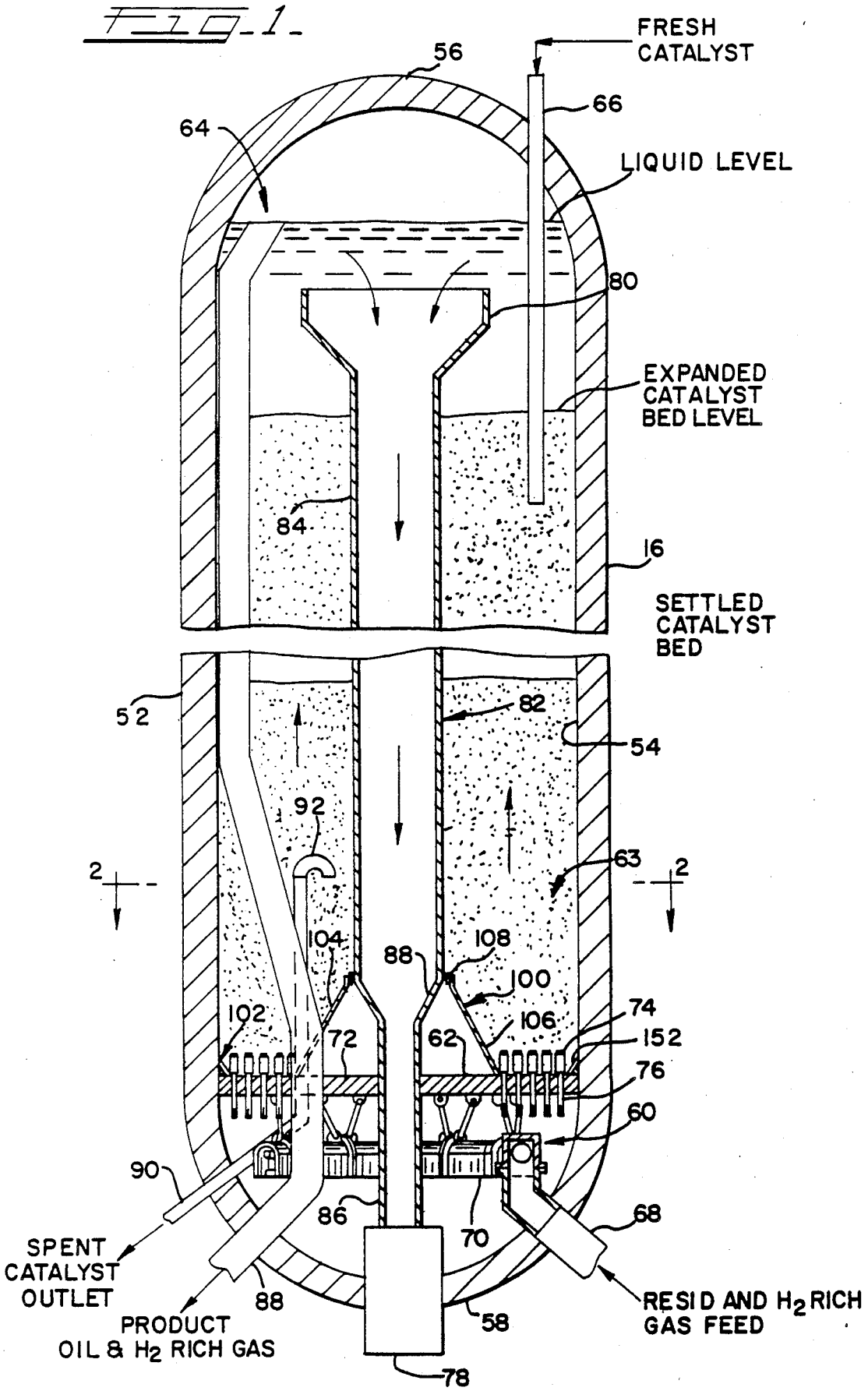
FIG. 1 is a cross-sectional view of an ebullated bed reactor containing deflectors for preventing catalyst slumping in accordance with principles of the present invention.

As shown in FIG. 1, each ebullated bed reactor 16, 18, and 20 comprises an upright elongated vessel 52 with upright elongated walls 54, a domed top 56 providing a roof (top head), a curved concave bottom 58 providing a floor (bottom head). The interior of the reactor has a lower feed zone 60 in the lower portion of the reactor below the grid 62, a reaction zone 63 in the intermediate portion of the reactor above the grid 62, and a product withdrawal zone 64 in the upper portion of the reactor above the intermediate portion.

Fresh hydrotreating catalyst can be fed downwardly into the top of the first ebullated bed reactor 16 through a fresh catalyst inlet feed line 66. Hot resid feed and hydrogen-containing feed gases enter the bottom of the first ebullated bed reactor 16 through a common combined feed line 68 and flow upwardly into an annular feed distributor 70. Preferably, separate oil and gas feed lines are connected to the common feed line 68. The feed distributor 70 comprises an octagonal manifold, torus, and header which provide a plenum chamber positioned within the interior of the bottom portion of the ebullated bed reactor 16 to mix and blend the oil and gas feed in a homogeneous manner and to radially and annularly distribute the oil and gas feeds in a uniform flow pattern in the bottom portion of the reactor 16.

The uniform, homogeneous mixture of oil and gases flows upwardly through the grid 62. The grid comprises a bubble tray or distributor plate 72 containing an array (multitude) of bubble caps 74 and upright risers 76 which help further distribute the oil and gas across the reactor 16 from the feed zone 60 to the reaction zone 63, and prevent catalyst from falling into the bottom section (lower portion) of the reactor below the grid 62. An ebullating pump 78 circulates oil from a recycle pan 80 through the grid 62 and an upright elongated tubular downcomer 82 which extends along the vertical axis and central portion of the reactor. The rate is sufficient to lift and expand the catalyst bed from its initial settled level to its steady state expanded level.

The downcomer 82 has an upright elongated upper portion 84 which extends vertically above the grid 62, a lower portion 86 which extends vertically below the grid 64, and an inverted frustoconical neck 88 which connects the upper and lower portions 84 and 86. The recycle pan 80 is connected to and positioned above the upper portion 84 of the downcomer 82.

The effluent product stream of partially hydrotreated oil and hydrogen-rich tail gases (off gases) is withdrawn from the reactor 16 through an effluent product withdrawal line 88. The used spent catalyst is withdrawn from the bottom of the reactor through a spent catalyst discharge (outlet) line 90 with a hooked inlet portion 92. The spent catalyst typically contains deposits of metals, such as nickel and vanadium, which have been removed from the influent feed oil (resid) during hydrotreating.

Catalyst particles are suspended in a two-phase mixture of oil, and hydrogen-rich feed gases in the reaction zone 62 of the reactor. Hydrogen-rich feed gases typically continually bubble through the oil. The random ebullating motion of the catalyst particles results in a turbulent mixture of the phases which promotes good contact mixing and minimizes temperature gradients.

The cascading of the ebullated bed reactors 16, 18, and 20 in a series of three per reactor train, in which the effluent of one reactor serves as the feed to the next reactor, greatly improves the catalytic performance of the back mixed ebullated bed process. Increasing the catalyst replacement rate increases the average catalyst activity.

In order to minimize catalyst slumping, clustering, agglomeration, buildup, accumulation, sticking (adhesion), stagnation, and piling of catalyst against the walls of the reactor 16, downcomer 82, and grid 62, the reactor 16 has at least one deflector. In the embodiment of FIG. 1, the reactor has an inner central deflector 100 and an outer deflector 102. The deflectors 100 and 102 are made of rigid metal, such as steel, and are positioned concentrically about the downcomer 82. The set (array) of risers 76 and bubble caps 74 are positioned between the deflectors 100 and 102.

Figure 3:
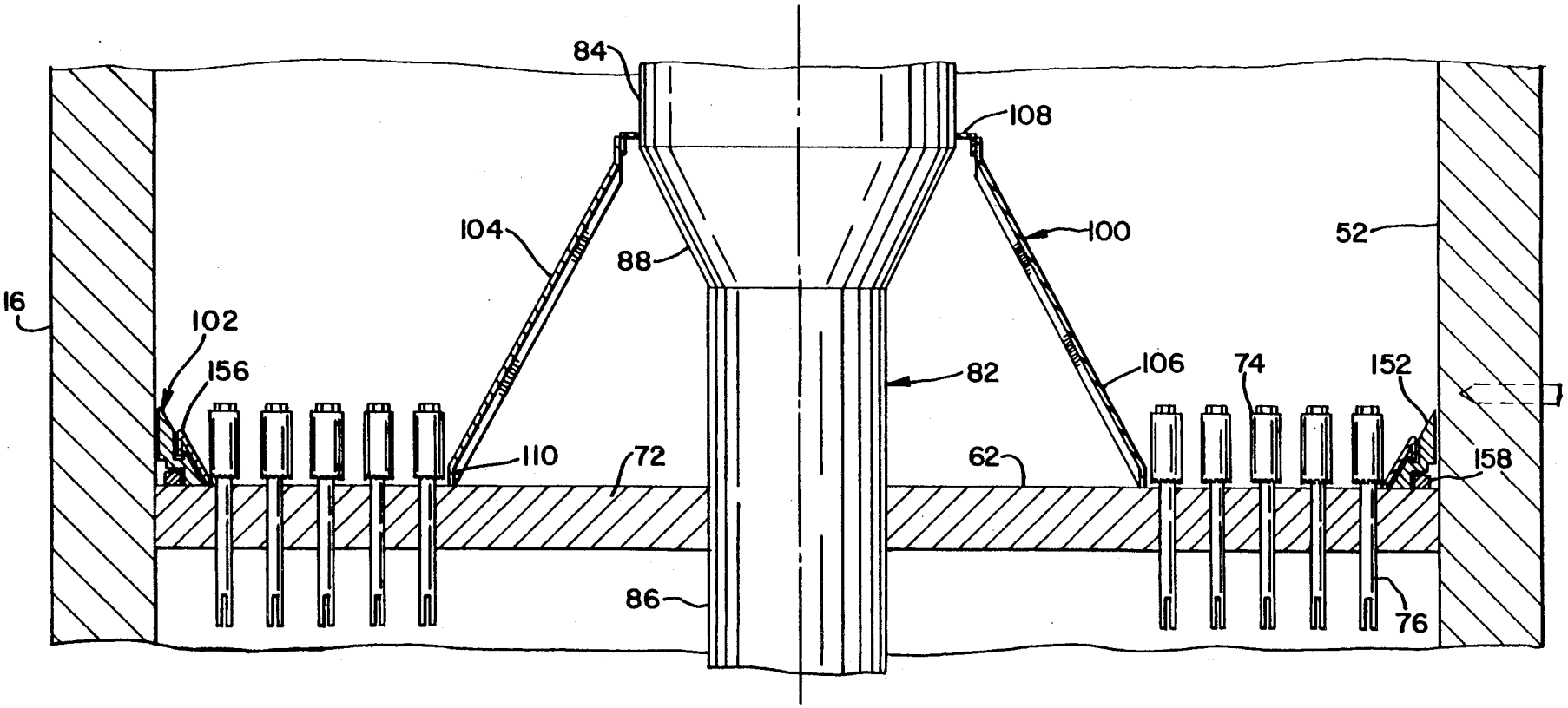
FIG. 3 is an enlarged cross-sectional view of the deflectors taken substantially along line 3—3 of FIG. 2.

As best shown in FIG. 3, the inner central deflector 100 comprises a frustoconical annular internal baffle 104 with a downwardly sloping, flared, and inclined outer wall 106 which is inclined at an angle of inclination ranging from about 15 degrees to about 75 degrees, most preferably from about 30 degrees to about 60 degrees, toward the horizontal grid 62 and away from the vertical walls of the downcomer 82. The central deflector 100 has an annular upper shoulder, packing ring, clip, or ledge 108 which is connected to the downcomer 82 slightly about the neck 88 and has a lower annular upright leg 110 which is connected to the top of the grid 62.

Figure 2:
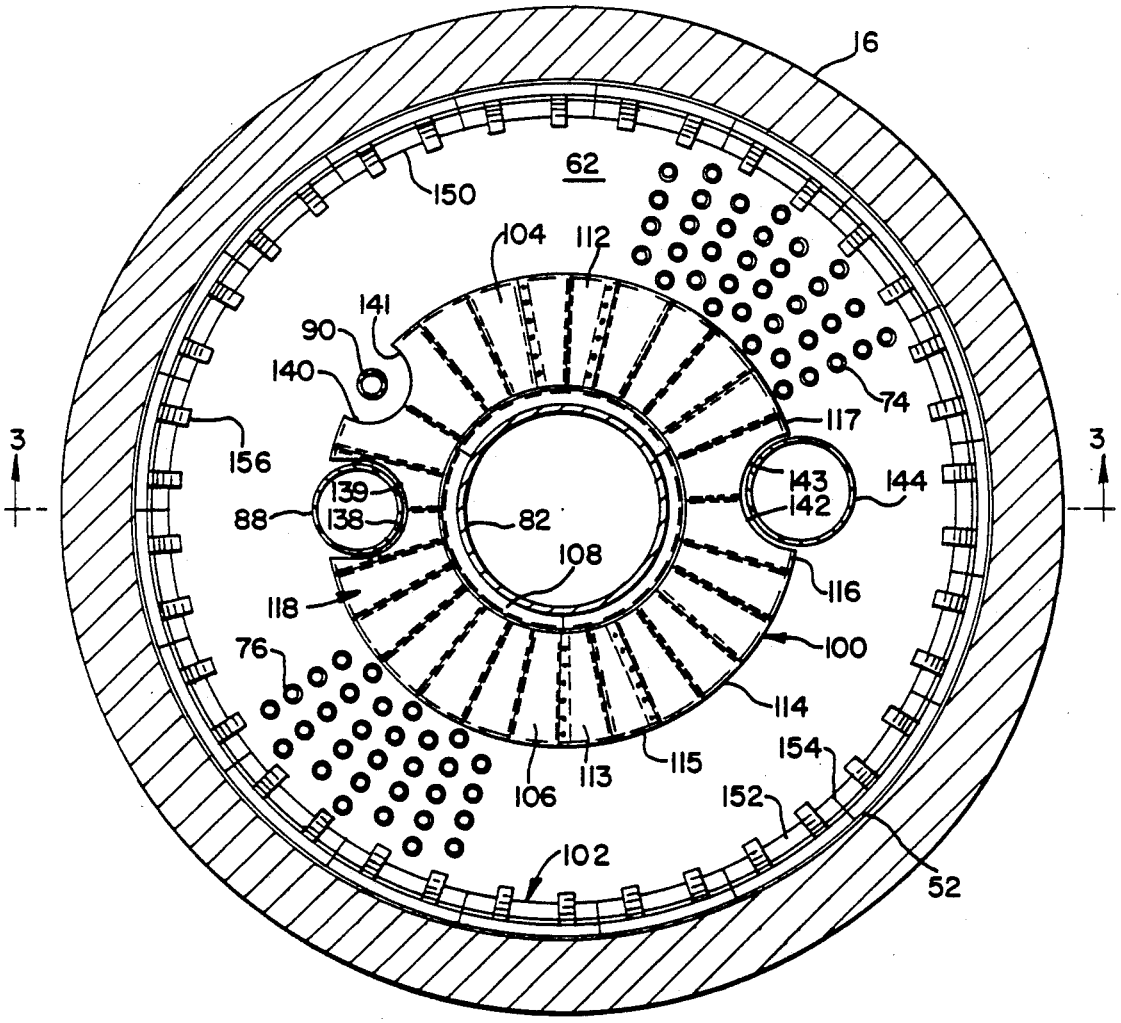
FIG. 2 is a cross-sectional view of the ebullated bed reactor taken substantially along line 2—2 of FIG. 1.
Figures 4, 5:
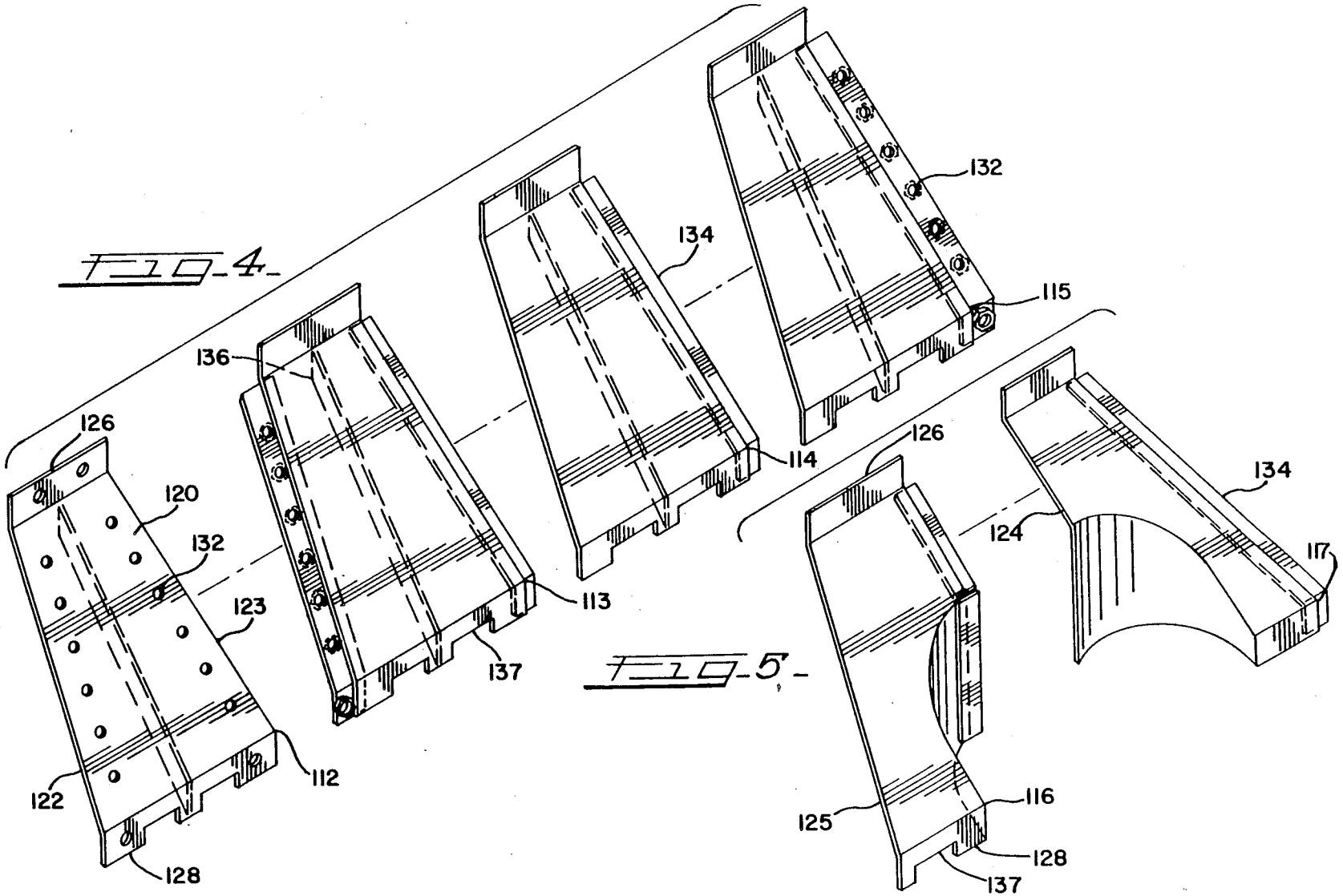
FIGS. 4 and 5 are enlarged perspective views of some of the deflector segments (pieces)

The central deflector 100, which is sometimes referred to as an ebullating cone, can be made of a set of interconnected complementary baffle segments, panels, or pieces 112–118, such as shown in FIGS. 2, 4 and 5, to accommodate retrofitting of the deflector in existing reactors. Each of the baffle segments (panels) has a generally planar or flat, frustoconical main body portion 120 with diverging flared sides, such as 122–125, an upper upright shoulder portion 126, and a lower upright leg portion 130. Some of the baffle segments have bolt holes 132, one or more welding strips 134, and reinforcing stiffener rods 136. Some of the leg portions 130 have inverted U-shaped openings or passageways 137. Some of the baffle segments have arcuate cutaway portions 138–143 to accommodate the product withdrawal line 88, spent catalyst outlet line 90, and a manway 144 (FIG. 2) providing an entrance and exit for maintenance personnel.

As best shown in FIG. 3, the outer deflector 102 is shorter but has a much greater diameter than the central deflector 100. The outer deflector 102 comprises an annular outer internal baffle ring or cuneiform insert 150 with a generally triangular or wedge-shaped cross-section. The outer baffle 150 has a downwardly sloping, inclined, and flared inner wall 152 which is inclined at an angle ranging from about 15 degrees to about 75 degrees, preferably about 30 degrees to about 60 degrees, toward the horizontal grid 62 and away from the vertical walls 54 of the reactor 16. The outer deflector which is sometimes referred to as an outer half cone, can be made of a set of interconnected complementary baffle segments, panels, or pieces 154 (FIG. 2). The baffle segments (panels) 154 can be connected by hooked clips or inverted J-shaped cone clips 156 (FIGS. 2 and 3) and can be seated adjacent an outer filler bar or ring 158 (FIG. 3).

Figure 6:
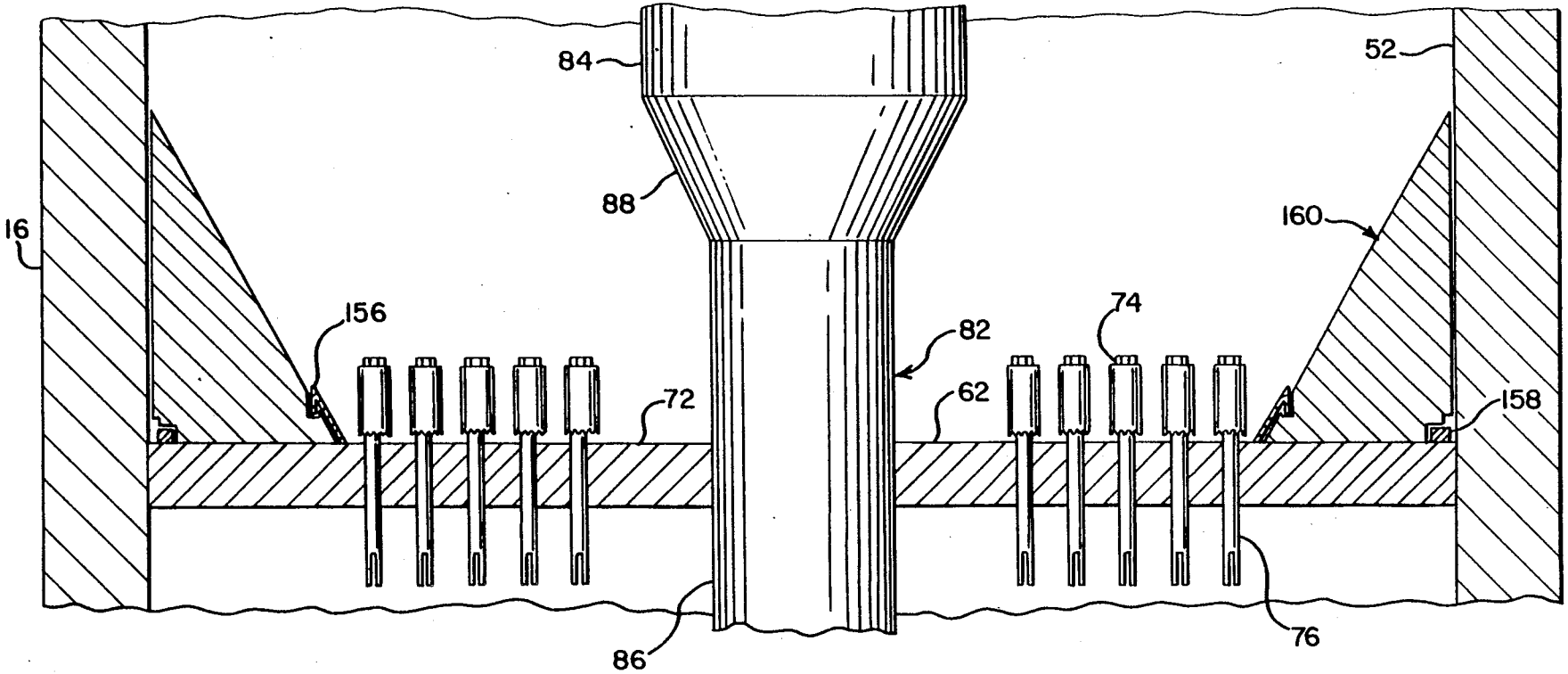
FIG. 6 is similar to FIG. 3 but with a larger outer deflector and no inner deflector.

In some reactors, it may be desirable to only use an outer deflector 160 (FIG. 6) without a central deflector 100 (FIG. 3). The outer deflector 160 of FIG. 6 is similar to the outer deflector 102 of FIG. 3 except it is taller and larger. The bubble caps 74 and risers 76 of FIG. 6 can extend to a position closely adjacent the downcomer 82.

In use, the resid feedstock is blended and conveyed with gas oil, combined with hydrogen-rich gases, and fed into the lower feed zone 60 of the reactor 16 by a common feed line 68. The oil-gas feed flows through the feed distributor 70 and upwardly through the risers 76 and bubble caps to the reaction zone 63 above the grid 62.

In the reaction zone 63, the oil and gas feeds are hydroprocessed in the presence of the fresh hydrotreating catalyst to produce an effluent product stream of upgraded hydrotreated oil and light hydrocarbons (off gases) which is withdrawn from the ebullated bed reactor 16 through the effluent product line 88. The used spent catalyst is withdrawn from the bottom of the ebullated bed reactor 16 through the spent catalyst discharge line 90. The deflectors 100 and 102 cooperate with each other to promote catalyst movement and activity and decrease catalyst stagnation, slumping, and building, as does deflector 160 (FIG. 6).

The novel feed resid hydrotreating units, deflectors (baffles), and processes have been extensively tested at the Amoco Oil Company Refinery in Texas City, Texas and have been found to produce unexpected, surprisingly good results.

Among the many advantages of the novel resid hydrotreating units, deflectors (baffles), and processes are:

1. Minimizes catalyst slumping and buildup on the walls of the reactor and downcomer.
2. Increases catalyst movement and activity.
3. Decreases catalyst stagnation.
4. Prevents clumping of catalyst.
5. Minimizes catalyst agglomeration and piling on the grid.
6. Increased conversion of resid to more valuable products.
7. Superior mixing, ebullation, blending, dispersion, and distribution of oil, gas, and catalyst.
8. Excellent process efficiency.
9. Improved process effectiveness.
10. Establishes a more stable, uniform gas-liquid-catalyst interface.
11. Better product quality.
12. Enhanced operability.
13. Lower operating and maintenance costs.
14. Reduced downtime.
15. Helps prevent coking above and on the grid.
16. Minimizes temperature gradients.
17. Can be retrofitted to existing reactors.
18. Mechanically easy to install.
19. Avoids blockage and plugging of the catalyst withdrawal line.
20. Easier to remove catalyst from the reactor.

Although embodiments of this invention have been shown and described, it is to be understood that various modifications and substitutions, as well as rearrangements and combinations of process steps and equipment, can be made by those skilled in the art without departing from the novel spirit and scope of this invention.

What is claimed is:

1. A hydrotreating process, comprising the steps of:

feeding oil into an ebullated bed reactor;

injecting hydrogen-rich gases into said reactor;

dispensing a hydrotreating catalyst into said reactor to form a catalyst bed;

expanding said catalyst bed;

hydroprocessing, contacting, and mixing said oil and gases in the presence of said catalyst in said reactor to produce an upgraded hydrotreated oil; while concurrently substantially deflecting said catalyst downwardly and inwardly away from the walls of said reactor with an annular internal baffle positioned adjacent said walls in the bottom portion of the reactor while simultaneously substantially minimizing clustering of said catalyst in said reactor by increasing upward velocity of said oil and gases.

2. A hydrotreating process in accordance with claim 1 wherein said minimizing includes substantially preventing slumping of said catalyst.

3. A hydrotreating process in accordance with claim 1 wherein said minimizing comprises substantially minimizing buildup and agglomeration of said catalyst on the grid and walls of said reactor.

4. A hydrotreating process in accordance with claim 1 wherein said catalyst bed is expanded substantially uniformly.

5. A hydrotreating process, comprising the steps of:

blending a feedstock comprising resid with gas oil;

conveying said blended feedstock to a train of three ebullated bed reactors;

injecting hydrogen-rich gases into said blended feedstock;

dispersing hydrotreating catalyst into said reactors to form a catalyst bed in each of said reactors;

expanding said catalyst beds;

circulating said catalyst in said beds;

ebullating and hydrotreating said blended feed-stock and hydrogen-rich gases in the presence of said catalyst in said reactors to produce an upgraded hydrotreated oil; while deflecting said catalyst substantially downwardly and inwardly away from the walls of said reactors with an annular internal baffle positioned adjacent said walls and having a substantially triangular cross section while simultaneously substantially preventing buildup and slumping of said catalyst on the walls of said reactors so as to enhance uniform distribution of said gases and the production and yield of said hydrotreated oil.

6. A hydrotreating process in accordance with claim 5 including deflecting said catalyst substantially downwardly and outwardly away from the downcomers in said reactors with a substantially trapezoidal annular internal baffle positioned about said downcomers while concurrently substantially preventing buildup and slumping of said catalyst on external walls of said downcomers.

7. A hydrotreating process in accordance with claim 6 including substantially preventing piling of said catalyst on the grids of said reactors while substantially minimizing temperature gradients in said reactors.

8. A hydrotreating process in accordance with claim 6 including substantially minimizing gas channeling and hot spots in said reactor.

* * * * *